US008383223B2

(12) United States Patent
Barredo

(10) Patent No.: US 8,383,223 B2
(45) Date of Patent: Feb. 26, 2013

(54) ROLL OF FIBROUS CELLULOSE-BASED PRODUCT

(75) Inventor: Donald Barredo, Ingersheim (FR)

(73) Assignee: Georgia-Pacific France, Kunheim (FR)

( * ) Notice: Subject to any disclaimer, the term of this patent is extended or adjusted under 35 U.S.C. 154(b) by 146 days.

(21) Appl. No.: 12/532,860

(22) PCT Filed: Mar. 27, 2008

(86) PCT No.: PCT/FR2008/050531

§ 371 (c)(1),
(2), (4) Date: Nov. 3, 2009

(87) PCT Pub. No.: WO2008/135690

PCT Pub. Date: Nov. 13, 2008

(65) Prior Publication Data

US 2010/0112264 A1 May 6, 2010

(30) Foreign Application Priority Data

Mar. 28, 2007 (FR) ..... 07 54097

(51) Int. Cl.
*B65D 65/28* (2006.01)
*G09F 3/00* (2006.01)

(52) U.S. Cl. ..... 428/43; 428/153; 428/154; 428/198; 428/906

(58) Field of Classification Search ..... 428/43, 428/153, 154, 192, 198, 906, 156, 172, 84, 428/81; 162/231
See application file for complete search history.

(56) References Cited

U.S. PATENT DOCUMENTS

| | | | |
|---|---|---|---|
| 901,723 | A | 10/1908 | Morse |
| D40,046 | S | 6/1909 | Stone |
| D40,322 | S | 10/1909 | Gair |
| D40,916 | S | 9/1910 | Gair |
| D63,341 | S | 11/1923 | Vanergaw et al. |
| D66,158 | S | 2/1924 | Vandergaw et al. |
| D66,341 | S | 12/1924 | Vandergaw et al. |
| D78,011 | S | 3/1929 | Currier at al. |
| D78,641 | S | 5/1929 | Manus |
| 1,983,813 | A | 12/1934 | Shy |
| D104,006 | S | 4/1937 | Goodstein |

(Continued)

FOREIGN PATENT DOCUMENTS

| | | | |
|---|---|---|---|
| DE | 2238005 | A1 | 2/1974 |
| EP | 0264676 | A1 | 4/1988 |

(Continued)

OTHER PUBLICATIONS

PCT International Search Report for Application No. PCT/FR2008/050531—filed Mar. 27, 2008.

(Continued)

*Primary Examiner* — Catherine A Simone
(74) *Attorney, Agent, or Firm* — Drinker Biddle & Reath LLP

(57) ABSTRACT

A product made of tissue for sanitary or domestic use is aimed in particular at products in rolls such as rolls of bathroom tissue (or sanitary paper) and similar rolls. A roll of fibrous cellulosic product includes a rolled strip of sheets of tissue separated by perforated or pre-cut lines, the individual plies of each sheet being bonded over a peripheral surface area of between 4% and 60% of the total surface area of each sheet.

17 Claims, 3 Drawing Sheets

U.S. PATENT DOCUMENTS

| | | | | |
|---|---|---|---|---|
| D113,598 | S | | 2/1939 | Lawson |
| D118,716 | S | | 1/1940 | Zito |
| D127,228 | S | | 5/1941 | Erhard |
| D130,965 | S | | 12/1941 | Fitch |
| D154,344 | S | | 6/1949 | Stapler |
| D159,479 | S | | 8/1950 | Feder |
| 2,956,564 | A | | 10/1960 | Shoji |
| 3,377,224 | A | | 4/1968 | Gresham, et al. |
| 3,738,905 | A | | 6/1973 | Thomas |
| D243,471 | S | | 2/1977 | Schroeder |
| 4,601,938 | A | | 7/1986 | Deacon et al. |
| 4,759,967 | A | | 7/1988 | Bauernfeind |
| 4,978,565 | A | * | 12/1990 | Pigneul et al. ..... 428/156 |
| 5,173,351 | A | | 12/1992 | Ruppel et al. |
| D367,764 | S | | 3/1996 | Makoui et al. |
| D414,345 | S | | 9/1999 | Barnholtz et al. |
| 5,972,456 | A | * | 10/1999 | Esquivel ..... 428/43 |
| D421,528 | S | | 3/2000 | Shakora |
| D425,354 | S | | 5/2000 | Rogers et al. |
| D436,737 | S | | 1/2001 | Presutti |
| D450,934 | S | | 11/2001 | Duritsch et al. |
| 6,461,705 | B2 | | 10/2002 | Eichhorn |
| 6,599,614 | B1 | | 7/2003 | Roussel et al. |
| D494,766 | S | | 8/2004 | Boerschinger et al. |
| 6,805,766 | B1 | | 10/2004 | Roussel et al. |
| D502,004 | S | | 2/2005 | Olson et al. |
| 6,884,492 | B2 | | 4/2005 | Basler et al. |
| D508,613 | S | | 8/2005 | Knobloch et al. |
| D510,434 | S | | 10/2005 | Carlucci et al. |
| D518,647 | S | | 4/2006 | Kressner et al. |
| D518,965 | S | | 4/2006 | Enderby |
| D521,250 | S | | 5/2006 | Knobloch et al. |
| D521,251 | S | | 5/2006 | Enderby |
| D523,644 | S | | 6/2006 | Knobloch et al. |
| D530,520 | S | | 10/2006 | Leclere et al. |
| D535,107 | S | | 1/2007 | Knobloch et al. |
| D612,156 | S | | 3/2010 | Barredo et al. |
| D612,157 | S | | 3/2010 | Barredo et al. |
| 2003/0203164 | A1 | | 10/2003 | Healy et al. |
| 2003/0215605 | A1 | | 11/2003 | Muller |
| 2004/0103591 | A1 | | 6/2004 | Chornenky et al. |
| 2006/0062972 | A1 | | 3/2006 | Lefebvre Du Grosriez et al. |
| 2006/0113049 | A1 | | 6/2006 | Knobloch et al. |
| 2009/0162597 | A1 | | 6/2009 | Barredo et al. |
| 2010/0051219 | A1 | | 3/2010 | Barredo |

FOREIGN PATENT DOCUMENTS

| | | | | |
|---|---|---|---|---|
| EP | 0864014 | B1 | | 1/2002 |
| EP | 1353010 | A1 | | 10/2003 |
| EP | 1400199 | A | | 3/2004 |
| EP | 1428654 | A1 | | 6/2004 |
| EP | 1845193 | A1 | | 10/2007 |
| FR | 2653793 | B1 | | 1/1992 |
| FR | 2775698 | A1 | | 9/1999 |
| WO | 9720107 | A1 | | 6/1997 |
| WO | 9852745 | A1 | | 11/1998 |
| WO | 2006027810 | A1 | | 3/2006 |
| WO | WO 2006092817 | A1 | * | 9/2006 |

OTHER PUBLICATIONS

PCT Written opinion for Application No. PCT/FR2008/050531—filed Mar. 27, 2008.

PCT International Preliminary Report on Patentability, Chapter II for Application No. PCT/FR2008/050531—filed Mar. 27, 2008.

* cited by examiner

ROLL OF FIBROUS CELLULOSE-BASED PRODUCT

CROSS REFERENCE TO RELATED APPLICATIONS

This application claims benefit of priority under 35 U.S.C. 119 to French Patent Application No. 0754097, filed Mar. 28, 2007, and PCT/FR2008/050531, filed Mar. 27, 2008, the entire contents of which are hereby incorporated by reference.

BACKGROUND OF THE INVENTION

The present invention relates to the field of products made of tissue for sanitary or domestic use and is aimed in particular at products in rolls such as rolls of bathroom tissue (or sanitary paper) and similar rolls.

The subject of the invention is a roll consisting of articles based on a (or essentially made of a) fibrous cellulosic product. More particularly, and according to a preferred embodiment, the subject of the invention is a roll of which certain sheets, and again more preferably, of which each sheet comprising it, has a single pattern completely included in the format of the sheet(s), that is to say that it is not cut by one or more of the four edges that delimit the sheet (usually of rectangular shape or surface area).

In a general manner, products of the above type are already known packaged in roll form. In these rolls, the sheets of product to be dispensed are usually rolled on a central mandrel of cylindrical section made of cardboard or similar product. In the field concerned, the rolled sheets of value to the user are conventionally made from fibrous cellulosic products of (or mostly of) tissue and assembled in the form of one or more superposed connected plies (stratified products or of the "sandwich" type) that follow one another in single file on the roll, the sheets being separated from one another, in the direction perpendicular to the direction of unrolling of the sheets by perforated or pre-cut lines making it possible to tear off or detach one or more sheets from the roll.

In the case of rolls of multi-ply sheets, the various superposed plies of the same size are, depending on the intended use of the sheet and/or the requirements imposed by the desires of the consumer and/or the technical production constraints, more or less strongly connected together using various techniques of assembling the said plies.

Most frequently, the plies in a multi-ply product made essentially of tissue are joined by applying an adhesive between the said plies. The bonding is carried out by means of any adhesive product generally used in the field of sanitary and domestic papers to join plies together such as, for example, a polyvinyl alcohol in solution in an aqueous medium. This joining by bonding may be combined with another type, just as conventional, of joining plies that is purely mechanical and that consists in locally deforming, by crushing, the plies to be connected so that the latter, nested in one another under the pressure of a cylinder, are held together once the joining operation has ended.

In the case of bonding, the adhesive has hitherto been deposited uniformly over the whole surface area of the plies of the rolled product. Since the deposition of the adhesive is associated with the embossing pattern, this requires an embossing pattern that covers the whole surface area of the product.

The patterns currently used are therefore of relatively small size and repeated a certain number of times in the machine direction and cross direction of each sheet, usually with at least two similar or identical patterns per sheet of paper, for example bathroom tissue.

This creates a continuous succession of embossed patterns all along the sheets that follow one another when the product is unrolled from the roll, the said patterns being cut in a more or less random fashion when they encounter one of the lateral edges of the ribbon formed by the succession of the sheets coupled together when they are unrolled in the machine direction and when they encounter a transverse edge that forms in the cross direction when the user detaches a sheet from the roll and/or two sheets that follow one another. This is particularly critical and unattractive when the patterns are relatively large in their surface area relative to the dimensions of the sheet since these cuts break the pattern and may, by reason of the geometric shape of certain patterns, cause weakened zones to appear where the connections are, likewise due to the cutting of the pattern, weaker than what would be the case in a complete uncut pattern.

Another disadvantage associated with the abovementioned type of joining by bonding consists in a stiffening of the sheet of paper (because of the adhesive) and hence a more difficult and more tricky rolling. Furthermore, with a mechanical treatment of the embossing type, an "inside-out" effect is noted due to the protrusions particularly in the zone of use, that is to say in the central zone of the sheet of paper and an accelerated penetration of the paper by a liquid due to an effect called "tent canvas" effect at the aforementioned joining protrusions.

Finally, the strength at the embossing patterns is weakened in the zone of use due mainly to the destruction of the fibres.

These disadvantages are particularly important when the rolled paper is bathroom tissue or similar paper of which the main qualities sought are above all flexibility, softness, tear-strength (in particular when wet) and appearance.

There is therefore a real need to be able to offer the consumer a roll of paper of this type that combines both a presentable appearance, preferably original and able to be modified at will, with properties of strength, flexibility and softness at least equivalent to those of the known rolled products where the patterns are repeated at frequencies that can be very high and that are cut at the edges of the sheets in the rolled state or detached from the roll.

An advantage of the present invention is to alleviate at least certain of these disadvantages.

BRIEF DESCRIPTION OF THE INVENTION

An embodiment of the invention is a new scheme of joining that, in a product packaged in a roll, uses the standard configuration with a new disposition of the bonding and joining points.

Specifically, to obtain a comfortable and effective usage zone for the user, the joining points have been moved towards the periphery of the product, that is to say of the sheet and preferably of each sheet present on the roll. Two different zones are then created for each sheet: a zone called the "technical zone" or peripheral zone starting at the edges in the machine direction and/or cross direction and going towards the inside of the sheet and a zone called the "usage" zone situated in the centre of the product unit (a sheet).

The technical zone, that may include several portions of disjointed zones (which also leave one or more edges towards the centre of the sheet) serves mainly to join the plies and confers a certain peripheral stiffness desired in particular by the consumer. The surface area of the technical zone therefore varies between a lower limit corresponding to a sufficient delamination resistance and an upper limit where the product would become too stiff.

The usage zone that may also include several portions of disjointed zones (at or near the centre of the sheet) serves mainly to confer softness, thickness, flexibility, a barrier effect (diffusion) and/or resistance effect (for example to penetration).

All the surface areas of the two aforementioned zones or the combination of the surfaces of all the partial technical and usage zones that are complementary form the total surface area of the individual sheet, the succession of which is rolled up.

An embodiment of the present invention is therefore a roll of sheets based on a fibrous cellulosic product, such as bathroom tissue, comprising a rolled strip having a continuous succession of tissue-based sheets made by joining at least two individual plies, each sheet being kept, with the possibility of detachment, with the adjacent sheet or two sheets by one, respectively two pre-cut lines, wherein the at least two individual plies of each sheet are connected by bonding or by mechanical pressure along a peripheral zone of each sheet and in that the surface area of the peripheral zone represents between 4% and 60% of the total surface area of each sheet.

According to a particularly embodiment, a roll wherein at least one sheet, preferably each sheet, has, in its central zone not forming part of the peripheral zone, at least one pattern made by embossing and/or dry marking.

BRIEF DESCRIPTION OF THE DRAWINGS

The invention will be better understood thanks to the following description that relates to example embodiments, given as non-limiting examples and explained with reference to the appended schematic drawings in which.

DETAILED DESCRIPTION OF THE INVENTION

Figure 1:
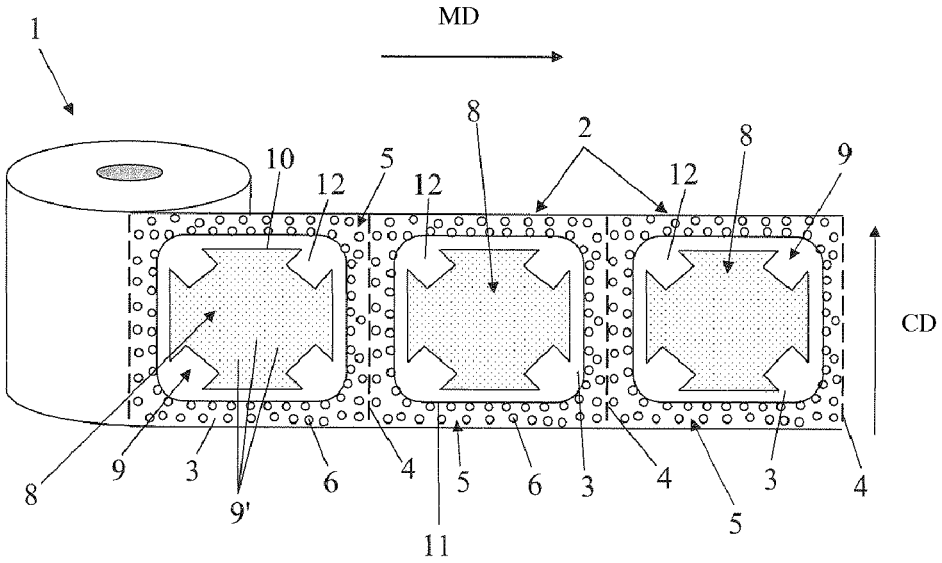
FIG. 1 represents schematically a first exemplary roll of sheets according to an embodiment of the invention.
Figure 2:
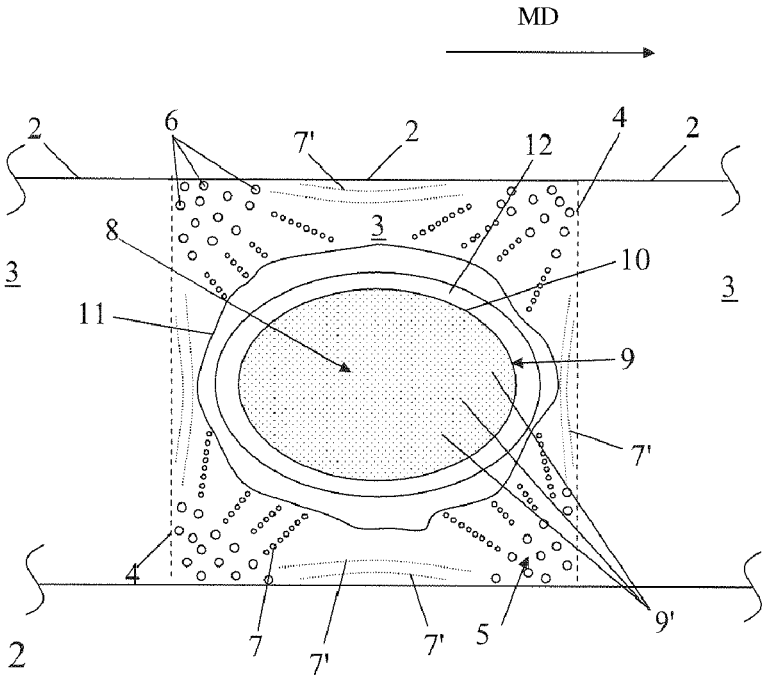
FIG. 2 represents schematically an enlarged view showing more precisely, and seen from above, an extract of a second exemplary roll of sheets according to an embodiment of the invention.

With reference to FIGS. 1 and 2, an embodiment of the present invention is therefore a roll 1 of sheets 2 based on a fibrous cellulosic product, such as bathroom tissue, comprising a rolled strip having a continuous succession of tissue-based sheets 2 made by joining at least two individual plies 3, each sheet 2 being kept, with the possibility of detachment, with the adjacent sheet or two sheets 2 by one, respectively two pre-cut lines 4, wherein the at least two individual plies 3 of each sheet 2 are connected by bonding or by mechanical pressure along a peripheral zone 5 of each sheet 2 and in that the surface area of the peripheral zone 5 represents between 4% and 60% of the total surface area of each sheet 2.

According to a variant, the aforementioned surface area represents between 50% (exclusive) and 60% (inclusive) of the total surface area of each sheet 2.

Preferably, the connection between the at least two individual plies 3 of each sheet 2 is achieved by adhesive bonding.

A sheet 2 consists of at least two superposed individual plies 3, usually of the same size and of the same rectangular, or even square, shape, whose standard dimensions usually vary between 90 mm and 140 mm for the length (therefore in the machine direction MD, that is to say parallel to the direction of travel of the rolled product) and between 80 mm and 110 mm for the width (hence in the cross direction CD, that is to say perpendicular to the direction of travel of the rolled product). In order to ensure a sufficient cohesion of the sheet 2 and to prevent any delamination of the latter, it will be possible advantageously to provide a connection of the plies 3 so that the resistance to delamination between each individual ply 3 is at least 1 g/cm.

For more clarity, the various superposed individual plies 3 have not been represented in the appended figures. It is accepted that, in the context of the present invention, the example shown comprises five rectangular superposed plies of the same size (14 cm×11 cm), the ply 3 shown in the appended figures being that situated on the outer face (visible to the user) of the roll 1 according to the invention.

The other plies (not shown) may be single plies provided over the whole of their face with a continuous and uniform regular micro-embossing having standard protrusions at a density of at least 20 protrusions/cm$^2$, preferably at a density of between 30 and 100 protrusions/cm$^2$. The plies 3, for example six in number, may be connected together thanks to a peripheral bonding, for example a bonding obtained by applying adhesive to a conventional embossing consisting of protrusions whose tops are of circular shape with a diameter of between 0.1 mm and 1.5 mm, preferably between 0.6 mm and 1.1 mm distributed evenly at a protrusion density of between 5 protrusions/cm$^2$ and 80 protrusions/cm$^2$, preferably between 5 protrusions/cm$^2$ and 30 protrusions/cm$^2$.

Alternatively, the bonding may be achieved by applying an adhesive to any embossing pattern but situated in the peripheral zone 5, as for example that resulting from the particular embossing represented in greater detail in FIG. 2 for another exemplary roll 1 according to the invention. A preferred mode of connection is that described in the French patent published under number FR-A-2 653 793 that makes it possible to make a uniform deposit of adhesive in the connection zone without stiffening the sheet.

Without departing from the context of the present invention, the connection between the at least two individual plies 3 of each sheet 2 may be achieved by any mechanical connection known to those skilled in the art making it possible to join purely physically at least two plies 3 together, for example by mechanical pressure, embossing, knurling, etc.

The number of individual plies 3 forming each sheet 2 may be between two and ten and preferably between four and seven individual plies 3.

The plies 3 are usually made of (pure or mostly) tissue of a basis weight of between 10 g/m$^2$ and 50 g/m$^2$ and may comprise the additives conventionally employed in this field because the latter do not interfere critically with the other technical features of the invention. The basis weights and the nature of the plies 3 may vary from one ply 3 to another but are preferably the same or substantially the same for all the plies 3 or for a large proportion of the plies 3. The basis weight of each sheet 2 is between 30 g/m$^2$ and 150 g/m$^2$, preferably between 85 g/m$^2$ and 115 g/m$^2$.

According to a first aspect of the invention, the roll 1 according to the invention is such that the totality of the connecting surface areas between the said plies 3 of at least one sheet 2, preferably of each sheet 2, is less than the surface area covered by the peripheral zone 5. In a particularly preferred manner, the surface area of connection between the plies 3 of at least one sheet 2, preferably of each sheet 2, is between 1% and 50%, preferably between 3% and 7%, of the total surface area covered by the peripheral zone 5.

This prevents over-stiffening the sheet 2 and in a novel and unexpected manner produces a roll 1 formed of flexible sheets 2.

The surface area of connection was adjusted so as to preserve the flexibility of the strip of the roll 1 formed by the succession of sheets 2 when the latter are still coupled to one another in order mainly to provide a good rolling of the said sheets 2 while retaining a good resistance to delamination of the latter.

"Peripheral zone" 5 means the zone beginning at one or more edges, and even all four edges or extremities of the surface area defining the sheet 2 (including it or including them) and extending towards the centre of the sheet 2. This prevents any gaping of the plies 3 or the formation of creases that impair the appearance of the product. An example of simple geometry of this peripheral zone 5 is a continuous rectilinear strip of constant thickness going all around the rectangular sheet 2. Naturally, the shape of the peripheral zone 5 may be irregular and/or discontinuous and/or curvilinear, etc., when it can define a surface area in which the joining of the plies 3 to be connected takes place and it is situated on the periphery of the sheet 2.

In a completely advantageous manner, the roll 1 according to an embodiment of the invention includes relatively "thick" sheets 2 which, while retaining good softness, roll perfectly to form a roll 1.

According to a preferred embodiment, the roll 1 according to an embodiment of the invention is such that the connection between the at least two individual plies 3 of each sheet 2 is made over the whole perimeter of at least one sheet 2, preferably of each sheet 2.

Advantageously, the connection between the at least two individual plies 3 of each sheet 2 is made in the peripheral zone 5 in a discontinuous manner, preferably by connection points 6 and/or by straight lines or portions of connecting straight lines 7 and/or by curved connecting line(s) 7'.

As shown in FIGS. 1 and 2, the roll 1 according to an embodiment of the invention is, in a particular bonded example, such that the adhesive is deposited in the peripheral zone 5 in a discontinuous manner, here by connection points 6, therefore bonding points (of round or substantially round shape) distributed in the peripheral zone 5. For reasons of clarity only a portion of the connection or bonding points 6 has been shown in FIG. 2, the other connection or bonding points 6 being suggested by dotted lines. Equally for reasons of clarity, the existence of the adjacent sheets 2 to the left and right of the sheet 2 represented in FIG. 2 has been suggested only by the drawing of the general contour without representing the details of these sheets 2 that are identical to that represented in detail in the centre of FIG. 2.

Advantageously, and in the most usual case with respect to joining the various plies 3, the aforementioned connection points 6 are situated over at least a portion of a connecting straight line 7 having as its origin one or more of the four corners of at least one sheet 2, preferably of each sheet 2, and directed towards the inside or the edge adjacent to the corner of the sheet or sheets 2.

According to another aspect, the connecting straight line portion(s) 7 are not parallel with the sides defining the length and/or the width of a sheet 2, preferably of each sheet 2.

It is therefore possible to draw portions of connecting straight lines 7 evoking sun rays that radiate from one or each of the four corners of the sheet 2.

According to a variant, the roll 1 according to an embodiment of the invention is also such that the connection points 6 are situated on at least one arc of circle curved connecting line 7' whose two ends are situated on one and the same edge of one or of each sheet 2 and whose concavity is directed towards the inside of the sheet or sheets 2. Such curved connecting lines 7' have also been suggested in FIG. 2.

Advantageously, the spacing between the adjacent connection points 6 of one and the same portion of a straight connecting line 7 or curved connecting line 7' is not uniform, on at least one sheet 2, preferably on each sheet 2.

As can be seen in FIG. 2, the distance between two adjacent connection points 6 situated on one and the same connecting straight line 7 may vary and, as shown, for example reduce as it comes closer to the centre of the sheet 2.

This makes it possible to create aesthetic effects and to play on the density of connection points 6 in the peripheral zone 5.

Specifically, by reducing the surface area of joining in the peripheral zone 5 the pressure applied locally to the ply 3 and hence the penetration of the adhesive into the various superposed plies 3 to be assembled is increased by constant stress of embossing.

According to a variant, it is possible to provide for the spacing of the connection points 6 to be uniform on at least one sheet 2, preferably on each sheet 2.

According to a particularly preferred embodiment, the roll 1 according to the invention is such that at least one sheet 2, preferably each sheet 2, has, in its central zone 8 not forming part of the peripheral zone 5, at least one pattern 9 made by embossing and/or dry marking.

Advantageously, the pattern or patterns 9 are made in the form of line(s) and/or point(s) of patterns 9'.

Preferably, the pattern(s) 9 are made in the form of at least one closed surface area embossed evenly at a general density of points of pattern 9' in the form of protrusions due to the embossing of between 20 protrusions/cm$^2$ and 100 protrusions/cm$^2$, preferably between 60 protrusions/cm$^2$ and 100 protrusions/cm$^2$, the diameter of the circular-section tops of the protrusions being between 0.1 mm and 1.5 mm, preferably between 0.3 mm and 0.6 mm.

In the examples illustrated in FIGS. 1 and 2, the pattern 9 is a specific square geometric shape or an oval embossed with conventional round protrusions.

Most preferably, the roll 1 according to an embodiment of the invention is such that at least one sheet 2, preferably each sheet 2, comprises only one pattern 9 completely included in the surface area not belonging to the peripheral zone 5 of the sheet 2 or of each sheet 2.

Unlike the known repetitive patterns, there is therefore no risk here that a pattern 9, preferably centred on the sheet 2, is cut by a lateral edge or an edge defined by a pre-cut line 4.

On this subject, it will be noted that the term "pre-cut line" 4 also includes non-rectilinear borders (for example wavy) even if straight pre-cut lines 4 are greatly preferred. These lines are conventional and formed by all the techniques known to and habitually employed by those skilled in the art, for example by stamping or cutting with appropriate blades in an ad hoc device at the reeling head where the rolls are formed. The pre-cutting may be carried out according to perforations in the form of dotted lines (rounds) or dashes (segments).

According to another feature, between the contour(s) 10 of the pattern(s) 9 and the contours 11 delimiting the peripheral zone 5, there is at least one free zone 12 containing no embossing, dry marking or other distinctive mark.

In this way, the contrast between the said pattern 9 and the rest of the ply 3 is reinforced.

According to a variant, the pattern(s) 9 comprise one or more figures and/or one or more letters.

In this way it is possible to mark and personalize the rolled product with any message, an advertising slogan, the name (commercial brand of the product) or similar items.

In a particularly worthwhile manner, it is possible to provide that the total number of types of different patterns 9 present on one and the same complete roll 1 is a whole number between 1 and 25, preferably between 1 and 6. It is possible in this way where necessary to provide several types of different patterns 9 simultaneously present on one and the same roll 1, still at the rate of one pattern per sheet 2.

An embodiment of the present invention is also such that the roll 1 comprises at least one sheet 2 having in its central zone 8, not forming part of the peripheral zone 5, no pattern 9 made by embossing and/or dry marking. In this way it is possible to leave one or more sheets 2 blank in their central zones 8, which makes it possible again to increase the number of product combinations that can be obtained.

Advantageously, the sheets 2 having a pattern 9 alternate with sheets 2 having no pattern 9.

Preferably, the alternation consists in the succession of a sheet 2 provided with a pattern 9 with exactly one sheet 2 not provided with a pattern 9, etc.

To produce a product according to the invention, it is possible to use any conventional installation known in the papermaking field. In such a conventional installation, two main plies 3 made of tissue, one and/or the other being able to be multi-ply laminates, coming from their respective reels are guided to pass around two rubber cylinders and then between the latter and two steel embossing cylinders provided with appropriate reliefs. These reliefs may, for example, be distributed according to the patterns visible in FIGS. 1 and 2. One of the two aforementioned plies 3 has adhesive applied to it by means of a gluing cylinder (or applicator cylinder) made of rubber that comprises a portion in relief whose design corresponds to that of the peripheral zone 5 of adhesive application of the sheets 2 so that the adhesive drawn by the applicator cylinder is distributed in this pattern. It is possible to emboss one or both sheets 2 over the whole of their surface area. The adhesive is applied only to the peripheral zone 5 corresponding to the portion in relief of the gluing cylinder. According to another embodiment, one of the two or both cylinders are provided with reliefs, on a peripheral zone 5 of the desired format of the rolled product. It is then possible to use a smooth gluing cylinder.

After the adhesive is applied, the two main plies 3 are assembled in the pinch gap made between the embossing cylinders that rotate at equal speeds and in opposite directions.

According to a variant, a single or multiple ply 3 is embossed between a rubber cylinder and a steel cylinder suitably engraved, that is to say with reliefs on the periphery of the desired product format. The adhesive is deposited on the tops of the reliefs. Finally, a second, respectively third, ply 3 is pressed onto the ply 3 by means of a third rubber cylinder of the joining type. The second and third plies 3 may also be embossed before they are joined. This third cylinder thus joins the second, respectively the third, ply 3 to the first. For the third cylinder it is also possible to use a steel cylinder.

The multi-ply sheet 2 thus coming out of the manufacturing device is drawn to a reeling head where it is if necessary cut to the desired format or where the pre-cut lines 4 are formed at regular intervals in the strip of sheets 2 by an appropriate bladed device before the product is rolled in the form of the roll 1.

Tests:

Tests have been carried out to verify the technical effectiveness of the invention relative to another rolled product given as a comparative example.

Figure 3:
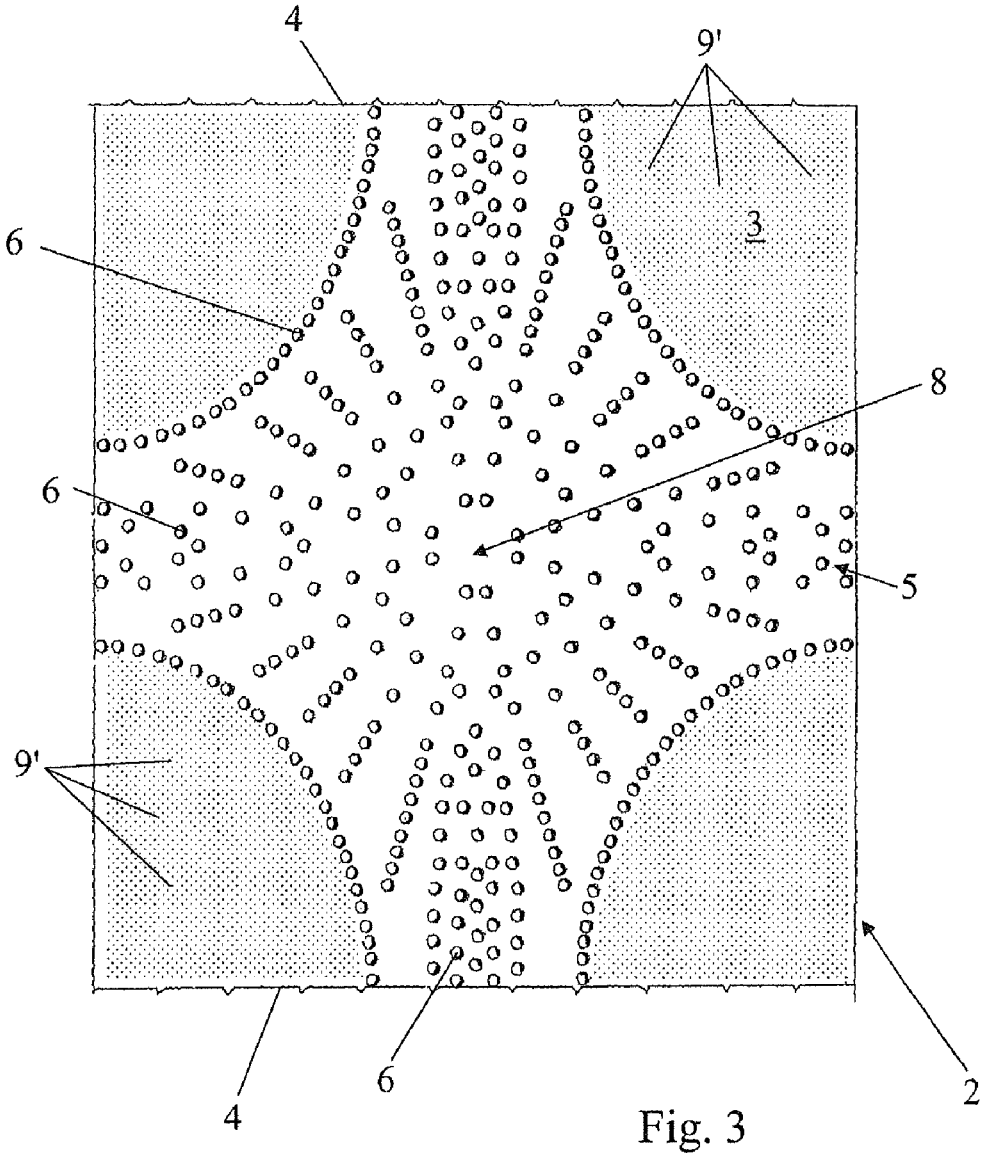
FIG. 3 represents schematically an enlarged view, and seen from above, of a multi-ply sheet of a product A not according to the invention and given as a comparative example.

A first product A in a roll of which a detached sheet 2 has been schematically represented in FIG. 3 consists of six plies of pure tissue each having a basis weight of 18.7 g/m$^2$. This product A was obtained by joining the said plies 3 by embossing/bonding with Forbo SWFT L998/4 adhesive in the pattern shown in FIG. 3 where the embossing/bonding is carried out via the connection points 6, namely, bonding points in the form of large protrusions 6 and distributed over a large portion of the sheet 2 and mainly in the central zone 8 of the latter. The four simply embossed zones (without bonding), for example by a conventional micro-embossing, are situated at the four corners of the said sheet 2. In these zones, the embossing is of the type constituting the pattern 9 in FIGS. 1 and 2, that is to say consisting of points of patterns 9'. All the other sheets 2 (not shown) of the roll 1 of product A are made in the same manner.

Figure 4:
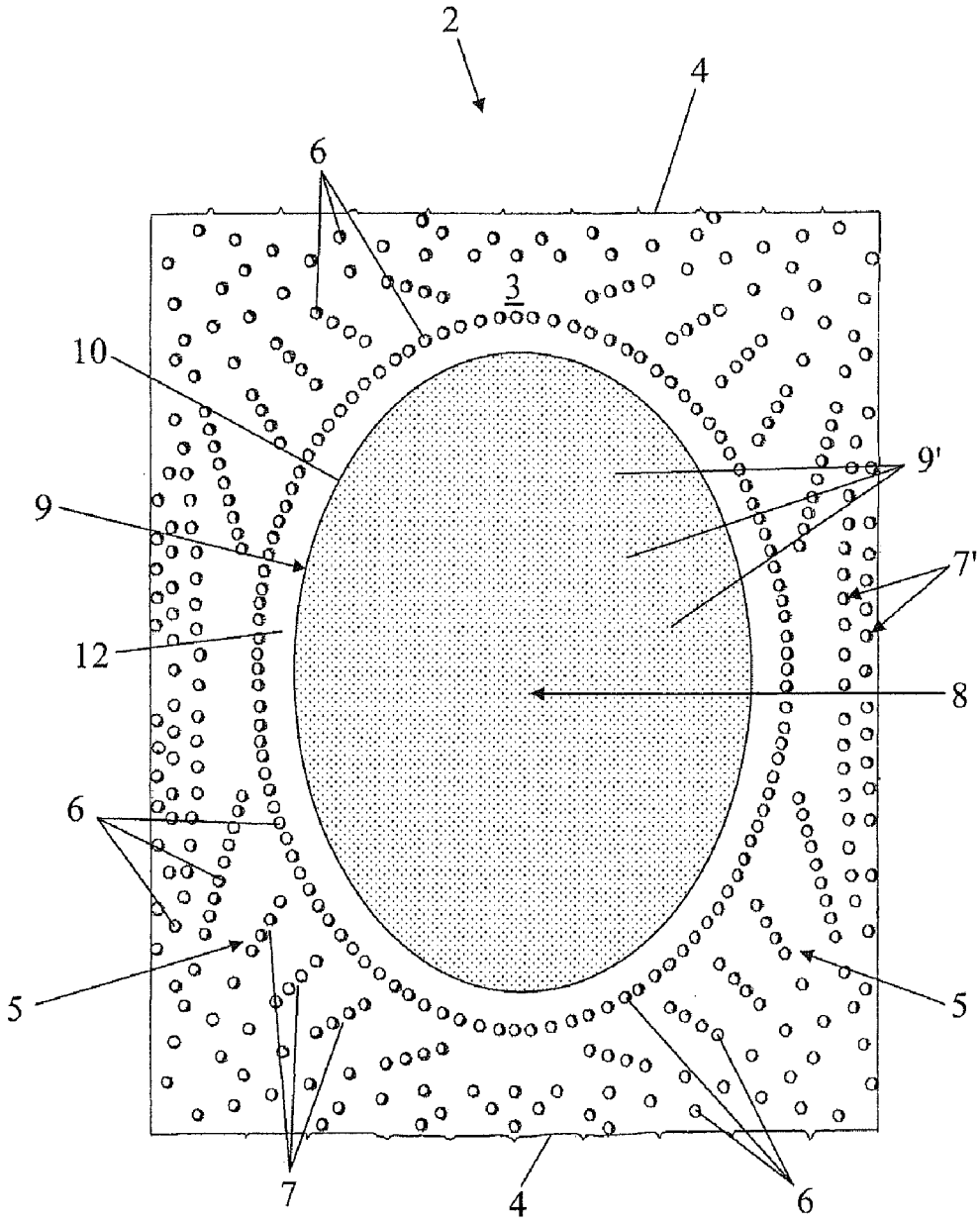
FIG. 4 represents schematically an enlarged view, and seen from above, of a multi-ply sheet of a product B according to an embodiment of the invention.

A comparison was made of the latter with a product B according to embodiments of the invention having the same plies as the product A but according to a joining of the said plies by an embossing/bonding according to the invention. The plies 3 of the sheet 2 of the product B were joined in the pattern shown in FIG. 4 (which also shows a sheet 2 detached from the roll 1) in which the embossing/bonding is carried out via the connection points 6, namely bonding points in the form of large protrusions 6 and distributed only over the peripheral zone 5 of the sheet 2. The simply embossed zone (without bonding) is situated in the central zone 8 of the said sheet 2. In this single zone, the embossing is of the type constituting the pattern 9 in FIGS. 1 and 2, that is to say consisting of points of patterns 9'. All the other sheets 2 (not shown) of the roll 1 of product B are also made in the same manner.

The results of the various comparative tests are given below.

Dry Strengths in N/m According to the Standard NF EN 12625-4:

| | MD strength | CD strength |
|---|---|---|
| Product A | 656 | 289 |
| Product B (invention) | 791 | 310 |

With an identical configuration of settings and of initial tissue, a marked improvement of strength is noted with embossing/joining only on the periphery of the product.

20% improvement is observed in strength in the machine direction and 7% in strength in the cross direction.

In addition, during the tension tests, it was noted that the unjoined central zone 8 offered the best protection for the user. Specifically, the first plies 3 to yield are in central plies, whereas with the joined usage zone, the first plies 3 that break are those on the outside.

Barrier Effect (Diffusion):

A penetration test was run on the two above products A and B:

The test consists in evenly distributing drops of ten microliters of distilled water in the central usage zone 8 and in checking whether or not these drops pass through the product.

With the product B according to the invention, only 9% of the drops pass through, unlike with conventional embossing/joining (product A) in which 100% of the drops pass through.

Flexibility:

The flexibility of the format, expressed in N, is determined by the method called "Ring & Rod" that consists in passing a sheet of a given surface area through a hole with a slightly larger diameter than the large diameter of a truncated cone surrounded by the sheet. The tensile force on the sheet is measured (in N) before and during its passage through the hole (in mm) During the passage through the hole, the slope of the curve changes and the value of the force at the point of inflection is taken.

For the abovementioned two products, the following were obtained:

Product A: 215+/−20 cN

Product B (according to the invention): 175+/−15 cN

An improvement of the order of 23% in flexibility relative to a known product is therefore found.

Softness:

Product A: inside-out effect even minimal

Product B: no inside-out effect because no through glueing picots.

Comparative consumer tests have been carried out between product B according to the invention and known products, for example of the "MOLTONEL" brand (registered trademark), tests according to which a marked improvement was found in softness, thickness and economy. The advantage that comes top relates to softness, then comes thickness and then economy of use.

It is indeed the simultaneity and synergy of these three characteristics that confer on the invention both its novelty and its inventiveness.

Naturally, the invention is not limited to the embodiments described and shown in the appended drawings. Modifications are still possible, particularly from the point of view of the constitution of the various elements or by substitution of equivalent techniques, without, for all that, departing from the field of protection of the invention.

The invention claimed is:

1. A roll of sheets based on a fibrous cellulosic product, comprising:

a rolled strip comprising a continuous succession of tissue-based sheets made by joining at least two individual plies, each sheet being detachable from an adjacent sheet by a pre-cut line, the at least two individual plies of each sheet being connected by adhesive bonding or by mechanical pressure along a peripheral zone defined at each of the edges of each sheet wherein the associated surface area of the peripheral zone represents between 4% and 60% of the total surface area of each sheet, and wherein the connection between the at least two individual plies of each sheet is made over the whole perimeter of the sheet with the adhesive bonding or the mechanical pressure provided at each of the edges of the sheet, wherein a surface area of connection between the plies of at least one sheet is between 3% and 7% of a total surface area covered by the peripheral zone.

2. The roll according to claim 1, wherein the connection between the at least two individual plies of each sheet is disposed in the peripheral zone in a discontinuous manner, comprising curved connecting lines.

3. The roll according to claim 1, wherein at least one sheet has, in its central zone not forming part of the peripheral zone, at least one pattern made by embossing and/or dry marking.

4. The roll according to claim 3, wherein the at least one pattern comprises lines and/or points of patterns.

5. The roll according to claim 3, wherein the at least one sheet comprises only one pattern completely included in a surface area not belonging to the peripheral zone of the at least one sheet.

6. The roll according to claim 3, wherein between a contour of the at least one pattern and contours delimiting the peripheral zone, there is disposed at least one free zone containing no embossing, dry marking or other distinctive mark.

7. The roll according to claim 3, wherein a total number of different types of the at least one pattern present on one and the same complete roll is a whole number between 1 and 25.

8. The roll according to claim 1, wherein at least one sheet having in its central zone not forming part of the peripheral zone, no pattern made by embossing and/or dry marking.

9. The roll according to claim 3, comprising sheets having the at least one pattern alternately arranged with sheets having no pattern.

10. The roll according to claim 1, wherein the at least two individual plies forming each sheet is between 4 and 7 individual plies.

11. The roll according to claim 1, wherein the basis weight of each sheet is between 30 g/m$^2$ and 150 g/m$^2$.

12. The roll according to claim 1, wherein a connection between the at least two individual plies of each sheet comprises adhesive bonding.

13. The roll according to claim 1, wherein the basis weight of each sheet is between 85g/m$^2$ and 115g/m$^2$.

14. A roll of sheets based on a fibrous cellulosic product, comprising:

a rolled strip comprising a continuous succession of tissue-based sheets made by joining at least two individual plies, each sheet being detachable from an adjacent sheet by a pre-cut line, the at least two individual plies of each sheet being connected by adhesive bonding disposed along a peripheral zone defined at each of the edges of each sheet wherein the associated surface area of the peripheral zone represents between 4% and 60% of the total surface area of each sheet, and wherein the connection between the at least two individual plies of each sheet is made over the whole perimeter of the sheet with the adhesive bonding disposed at each of the edges of the sheet, wherein a surface area of connection between the plies of at least one sheet is between 3% and 7% of a total surface area covered by the peripheral zone.

15. A method of forming a roll of sheets based on a fibrous cellulosic product, the roll of sheets comprising:

a rolled strip comprising a continuous succession of tissue-based sheets, each sheet being detachable from an adjacent sheet by a pre-cut line, the method comprising:

joining at least two individual plies for each sheet, the joining comprising disposing adhesive along a peripheral zone defined at each of the edges of each sheet wherein the associated surface area of the peripheral zone represents between 4% and 60% of the total surface area of each sheet, such that a connection between the at least two individual plies of each sheet is made over the whole perimeter of the sheet with the adhesive disposed at each of the edges of the sheet, wherein a surface area of connection between the plies of at least one sheet is between 3% and 7% of a total surface area covered by the peripheral zone.

16. The method according to claim 15, wherein the disposing of the adhesive comprises:

applying adhesive in a direction extending along a lengthwise dimension of the rolled strip; and applying adhesive in a direction transverse to the lengthwise dimension of the rolled strip.

17. A roll of sheets based on a fibrous cellulosic product, comprising:

a rolled strip comprising a continuous succession of tissue-based sheets made by joining at least two individual plies, each sheet being detachable from an adjacent sheet by a pre-cut line, the at least two individual plies of each sheet being connected by adhesive bonding or by mechanical pressure along a peripheral zone defined at each of the edges of each sheet wherein the associated surface area of the peripheral zone represents between 4% and 60% of the total surface area of each sheet, and wherein the connection between the at least two individual plies of each sheet is made over the whole perimeter of the sheet with the adhesive bonding or the mechanical pressure provided at each of the edges of the sheet, wherein the connection between the at least two individual plies of each sheet comprises a curved connecting line with ends situated on a same sheet edge and an inwardly directed concavity.

* * * * *